United States Patent [19]

Anetseder, Jr. et al.

[11] 4,103,387

[45] Aug. 1, 1978

[54] BRUSH WITH RETRACTABLE BRISTLES

[75] Inventors: Leopold Anetseder, Jr.; Leopold Anetseder, Sr., both of Munich, Germany

[73] Assignee: Leopold Anetseder, Jr., Munich, Germany

[21] Appl. No.: 713,214

[22] Filed: Aug. 10, 1976

[30] Foreign Application Priority Data

Aug. 11, 1975 [DE] Fed. Rep. of Germany ..... 2535773

[51] Int. Cl.[2] ..... A46B 9/10

[52] U.S. Cl. ..... 15/203

[58] Field of Search ..... 15/203, 201; 132/119, 132/120, 121, 122, 123

[56] References Cited

U.S. PATENT DOCUMENTS

| | | | |
|---|---|---|---|
| 1,231,093 | 6/1917 | Sundeen | 15/203 |
| 1,565,228 | 12/1925 | Johnson | 15/203 |
| 2,507,340 | 5/1950 | Vietes | 15/203 |
| 2,981,965 | 5/1961 | Kaye | 15/203 |
| 3,086,236 | 4/1963 | Anonsen | 15/203 |

*Primary Examiner*—Robert W. Jenkins

*Attorney, Agent, or Firm*—Karl F. Ross

[57] ABSTRACT

A collapsible hair or massage brush has a body divided into two flat, superposed members in the form of slotted plates or frames which are limitedly relatively shiftable in a predetermined direction to swing a multiplicity of bristle carriers, normally retracted into the body, through substantially 90° into a working position in which their bristles project perpendicularly from one of the body surfaces. The bristle carriers are journaled in one of the members by pivotal axles transverse to the shift direction, these axles being either individual to the respective carriers or common to groups of them lying in parallel rows. The carriers or their axles have coupling formations engaging coacting camming formations on the other member. An operating handle with resilient yoke legs has an inactive position flush with one of the members in which it prevents accidental shifting and holds the bristle carriers retracted; upon being swung out of its inactive position, the handle causes such shifting — or permits it to take place under spring action — whereupon its legs, fulcrumed on one member, snap into recesses of the other member to lock the bristles in their working position.

20 Claims, 36 Drawing Figures

FIG. 18
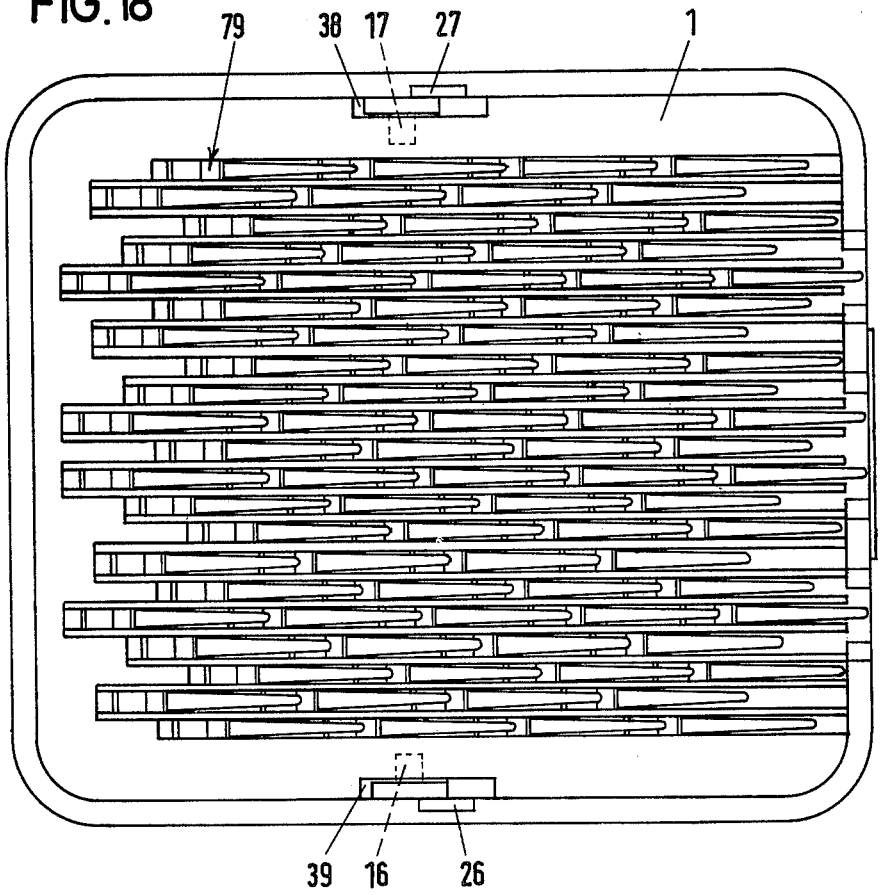
FIG. 19
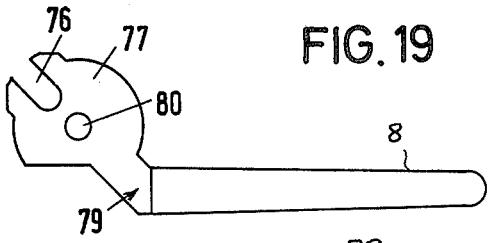
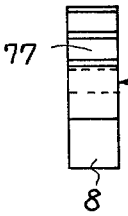
FIG. 19B
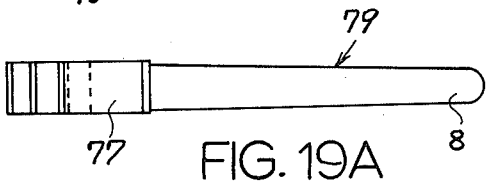
FIG. 19A

FIG. 23A
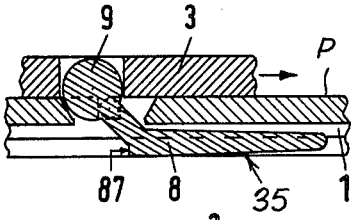
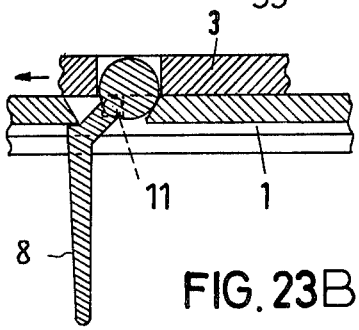
FIG. 23B
FIG. 24A
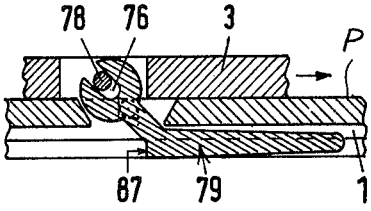
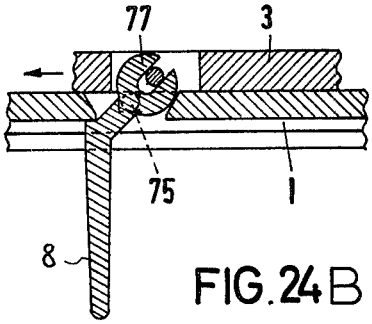
FIG. 24B
FIG. 25A
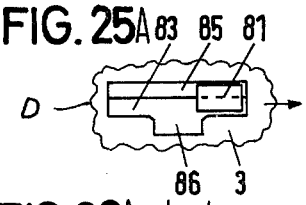
FIG. 25B
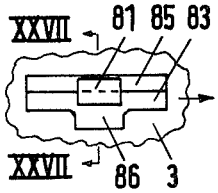
FIG. 25C
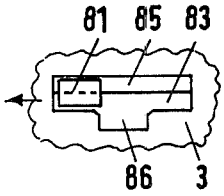
FIG. 26A
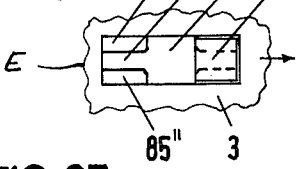
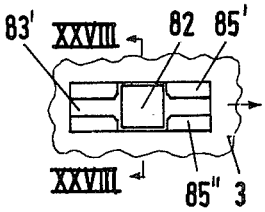
FIG. 26B
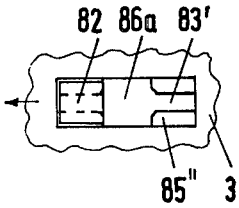
FIG. 26C
FIG. 27
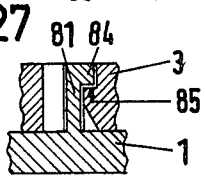
FIG. 28
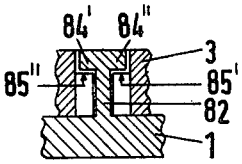

BRUSH WITH RETRACTABLE BRISTLES

1. Field of the Invention

Our present invention relates to a hair or massage brush of the collapsible type having retractable bristles.

2. Background of the Invention

A brush of this character has been described in U.S. Pat. No. 2,981,965. That brush comprises a casing in which a bar provided with rack teeth is slidable, this bar meshing with a set of gear segments mounted on bristle-carrying shafts; thus, a sliding of the bar along the casing bottom alternately retracts the bristles into the casing or extends them therefrom. The shifting of the bar is carried out with the aid of a pin projecting through a slot in the casing bottom.

OBJECTS OF THE INVENTION

The general object of our present invention is to provide an improved brush of the aforementioned collapsible type which is more compact than conventional constructions and which can therefore be carried more easily in a user's pocket or handbag.

Another object is to provide such a brush with a convenient operating handle which practically disappears in the collapsible position without requiring additional space in the body of the brush.

It is also an object of our invention to provide means in such a brush for positively preventing an untimely extension of its bristles, thus obviating the risk of damage to the brush itself or to nearby articles.

A related object is to provide means for positively holding the bristles extended so as to prevent the brush from collapsing in use.

SUMMARY OF THE INVENTION

In accordance with our present invention, the brush has a generally flat body split into two superposed members which are limitedly relatively displaceable along a parting plane and define opposite major surfaces of the body parallel to that plane. A set of bristle carriers journaled in one member are provided with coupling formations which extend across the parting plane and are engaged by coacting camming formations within the other member for swinging the carriers and their bristles, upon relative shifting of the two members, through an arc of substantially 90° about pivotal axes transverse to the shift direction whereby the bristles are retracted into the brush body in one stop position and project perpendicularly from one of its major surfaces in another stop position. This relative shifting of the two members is brought about by operating means preferably retractable into the brush body concurrently with the withdrawal of the bristles.

Each member of the brush body may be in the form of a perforated plate or just an open frame. The camming formations may be edges of apertures of one member designed to receive the coupling formations of the bristle carriers, or pins lodged in such apertures, with resulting reduction in the height of the body.

The coupling formations may be individual to the several bristle carriers or may be secured to one or both ends of a shaft common to a row of such carriers. They are advantageously designed as levers including an angle of about 45° with the parting plane in each stop position.

According to another important feature of our invention, the retractable operating means comprises a preferably yoke- or U-shaped handle pivoted to either or both members for rotation about a swing axis which is parallel to the pivotal axes of the bristle carriers. In an advantageous embodiment, a bight portion of the handle is receivable in a clearance formed between a transverse edge of one member and an abutment on the other member when the two members are in their inoperative position with the bristles withdrawn. In another embodiment the handle is positively linked with both members. In either case the handle prevents an accidental shifting into the working position as long as the user does not extract it from its seat. Upon such extraction the handle can be elevated on the side of the body opposite its bristle-studded surface, the resilient yoke legs of the handle then snapping into recesses on one member to hold the two members in the working position until these legs are forcibly disengaged from their recesses.

BRIEF DESCRIPTION OF THE DRAWING

The above and other features of our invention will now be described in detail with reference to the accompanying drawing in which:

FIG. 18 is a bottom view of the brush of FIGS. 15– 17;

FIG. 19 is a side view of a bristle unit forming part of the brush shown in FIGS. 15– 18;

FIGS. 19A and 19B are a top view and an end view of the bristle unit shown in FIG. 19;

FIGS. 23A, 23B and 24A, 24B are cross-sectional detail views of two types of bristle carriers in their retracted and working positions;

FIGS. 25A, 25B, 25C and 26A, 26B, 26C are plan views of coupling elements of the brush structure of FIGS. 15– 22 in three different positions; and FIGS. 27 and 28 are cross-sectional views taken on lines XXVII— XXVII and XXVIII— XXVIII of FIGS. 25B and 26B, respectively.

SPECIFIC DESCRIPTION

Figure 4:
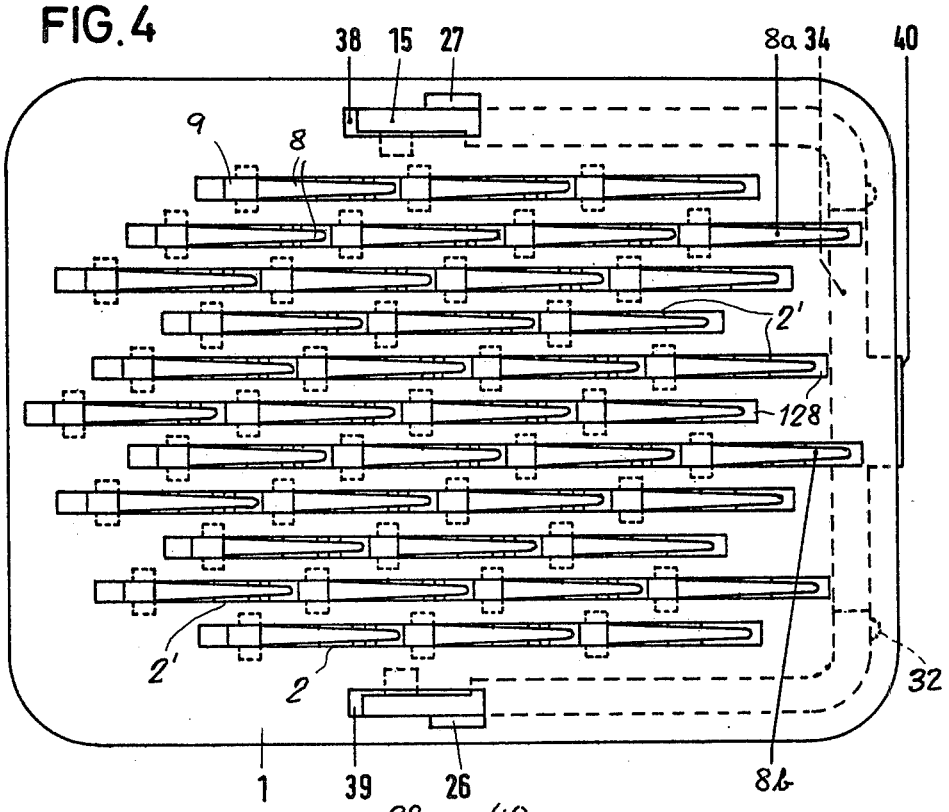
FIG. 4 is a bottom view of the brush shown in FIGS. 1– 3.

The embodiment of our invention illustrated in FIGS. 1- 7 comprises a bottom or base plate 1 of generally rectangular outline with an upstanding rim 1*a* embracing a top plate 3. The two plates 1, 3 together define the body of a brush and are relatively shiftable in a direction Z, along a parting plane P, within limits established by a clearance 31 between the right-hand edge 18 of plate 3 and the rim 1*a*. Members 1 and 3 are interconnected by a multiplicity of parallel slots 28, 28′ in plate 3 and bosses 2, 2′ of rectangular profile rising from plate 1, these bosses spanning slots 128 which extend in staggered relationship over nearly the full length of plate 1 as seen in FIG. 4. The substantially shorter slots 28 and 28′ of plate 3 register with slots 128 and are of the same width, slots 28 being rabbeted at 6 to receive heads 7 of pins 4 which are inserted from above into bores of bosses 2 and are peened over at their lower ends 5 to hold the two plates together. Bosses 2′ do not have pin holes and serve only for guidance in shift direction Z. In the illustrated embodiment there are ten bosses 2 and thirty bosses 2′ mating with as many slots 28 and 28′, respectively. The flat heads 7 of pins 4 lie slightly below the upper surface of top plate 3, e.g. by about 0.1 mm.

Figure 2:
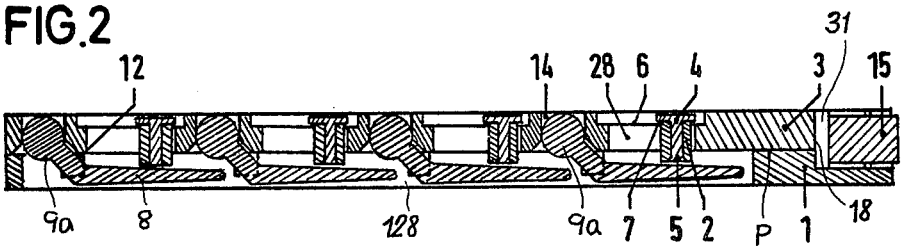
FIGS. 2 and 3 are cross-sectional views of the brush taken on lines II — II and III — III, respectively, of FIG. 1.
Figure 3:
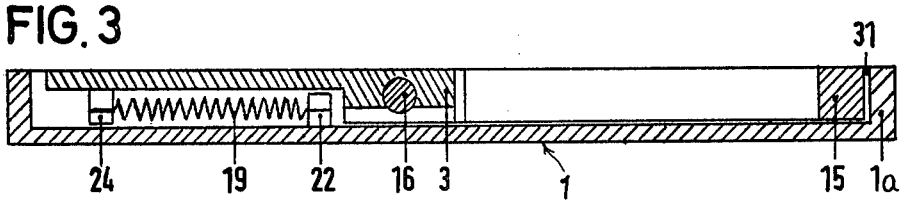
Figure 1:
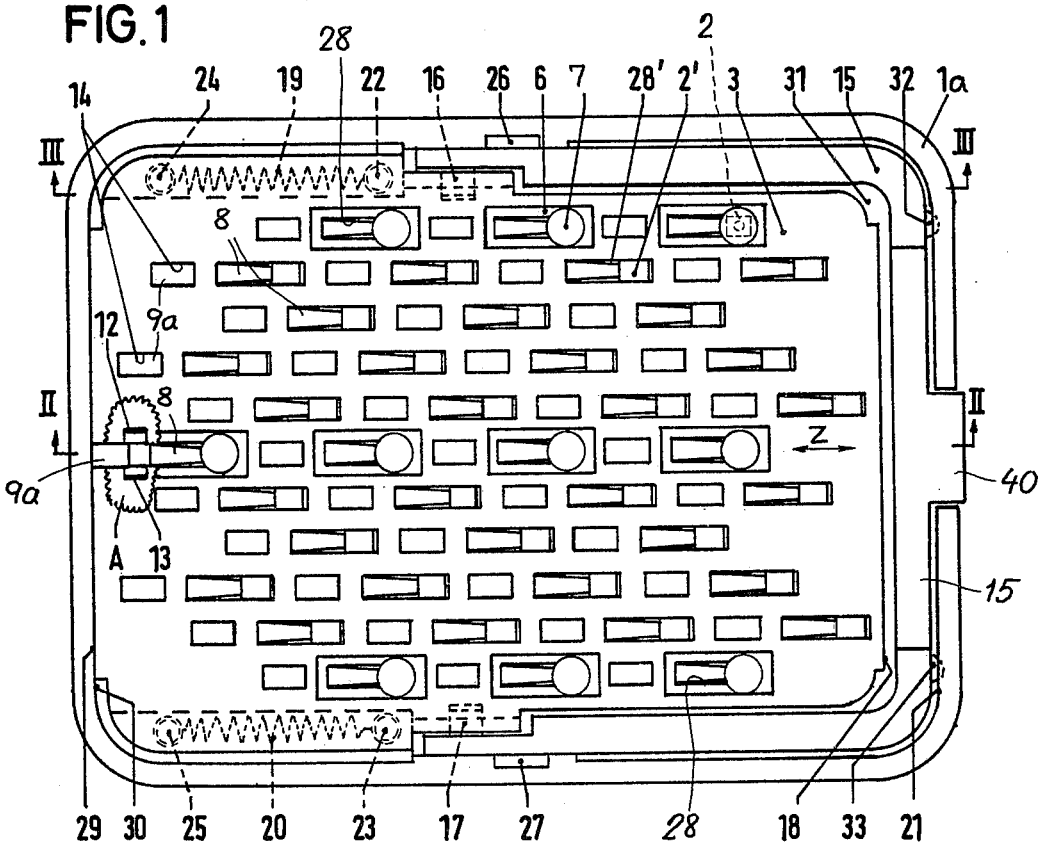
FIG. 1 is a top view of a brush according to the present invention in its collapsed state.
Figure 5:
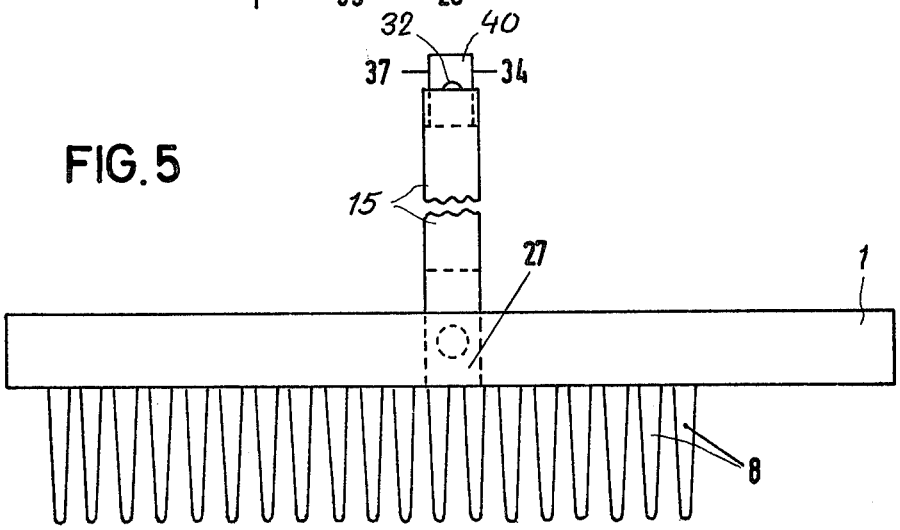
FIG. 5 is a side view of the same brush in its working position.
Figure 6:
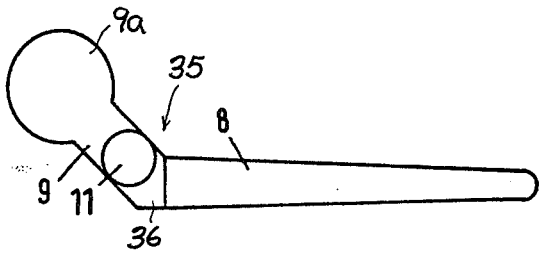
FIG. 6 is a side view of a bristle unit forming part of the brush shown in FIGS. 1– 5.
Figure 7:
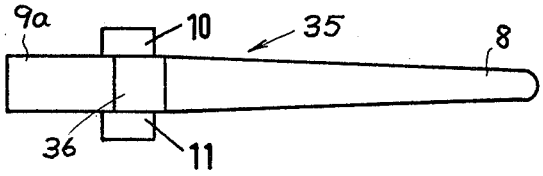
FIG. 7 is a top view of the bristle unit of FIG. 6.

The slots 128 of bottom plate 1 accommodate a multiplicity of bristle units 35 shown in FIGS. 6 and 7, each of these units comprising a bristle 8 on a carrier 36 which has gudgeons 10, 11 received in bearing recesses 12, 13 that are visible in a cut-away area A in FIG. 1. The bristles 8, here shown integral with their carriers, could of course also be replaced by respective tufts. Each carrier 36 has a coupling formation in the shape of an integral lever 9 which rises obliquely across plane P and terminates in a rounded bulge 9*a* received in a camming aperture 14 of plate 3 aligned with and closely spaced from a respective slot 28 or 28′. Thus, a sliding of plate 3 to the right, with reference to plate 1, entrains the bulges 9*a* of levers 9 in a clockwise sense (as viewed in FIG. 2) whereby the retracted bristles 8 are erected into their working position perpendicular to the major surfaces of the brush body as illustrated in FIG. 5. The bristles are shown to taper frustoconically toward their free ends, e.g. from a maximum diameter of 1.8 mm to a minumum diameter of 1.2 mm.

Two tension springs 19 and 20, anchored to plate 1 at 22, 23 and to plate 3 at 24, 25, urge the plate 3 in this rightward direction but are normally maintained ineffectual by the presence of a bight portion of a U-shaped handle 15 in the clearance 31. The legs of handle 15 are pivoted by pins 16, 17 to top plate 3 and are inherently biased outwardly so as to snap resiliently into lateral recesses 26, 27 on the rim 1*a* of bottom plate 1 after a tongue 40 on the handle has been lifted out of a cutout in that rim and the handle has been swung through 90° into the erect position of FIG. 5. The two members 1 and 3 are thus locked in their working position in which edge 18 of plate 3 bears upon an inner surface 21 of rim 1*a*. To return the assembly to its inoperative or collapsed state, the user squeezes the legs of handle 15 out of their recesses 26 and 27 (pivot pins 16 and 17 are long enough to remain engaged with plate 3 at all times) and represses the plate 3 to the left, until its left-hand edge 30 comes to rest against an opposite inner surface 29 of rim 1*a*, while returning the handle to its original position flush with plate 3. Detents such as ball checks 32, 33 releasably retain the handle 15 in that position by engaging in corresponding depressions of rim 1*a*. Cutouts 38 and 39 (FIG. 4) in bottom plate 1, in the region of pivots 16 and 17, accommodate the ends of the handle legs in the swung-out position.

As shown in FIG. 5, a side 34 of the bight portion of handle 15 is recessed to provide sufficient space for the tips 8*a*, 8*b* (FIG. 4) of certain bristles 8 which come to lie just below that part of the handle when retracted, this side 34 being the lower one when the handle is received in clearance 31. The opposite side 37 is also shown recessed for reasons of symmetry.

Whereas in the embodiment just described each bristle carrier 36 is individually journaled by means of gudgeons 10 and 11 for swinging about an axis transverse to the shift direction Z, we shall now describe with reference to FIGS. 8- 13 a modified arrangement in which carriers 48 are arrayed in columns and the carriers of each column (here three) are mounted on a common shaft 75 for joint camming displacement by a coupling lever 54 secured to an end of that shaft. Carriers 48 form part of respective bristle units 46 also including bristles (or tufts) 47. The three bristle units 46 on each shaft 75 form therewith a swingable assembly, these units being axially offset on adjoining assemblies 41, 42, 43, 44, 45 which recur throughout the array. A frame 50, corresponding to plate 1 of the preceding embodiment, may be regarded as the bottom member (even though it is shown on top in the cross-sectional views of FIGS. 9–12) since the bristles 47 project therefrom in the working position of FIG. 13; the other member of the brush body is a frame 49 slidable relatively to frame 50, to an extent permitted by a clearance *f* indicated in FIG. 8, along a parting plane P. Bristles 47 have a frustoconical shape similar to that of bristles 8 in FIGS. 6 and 7.

Figure 8:
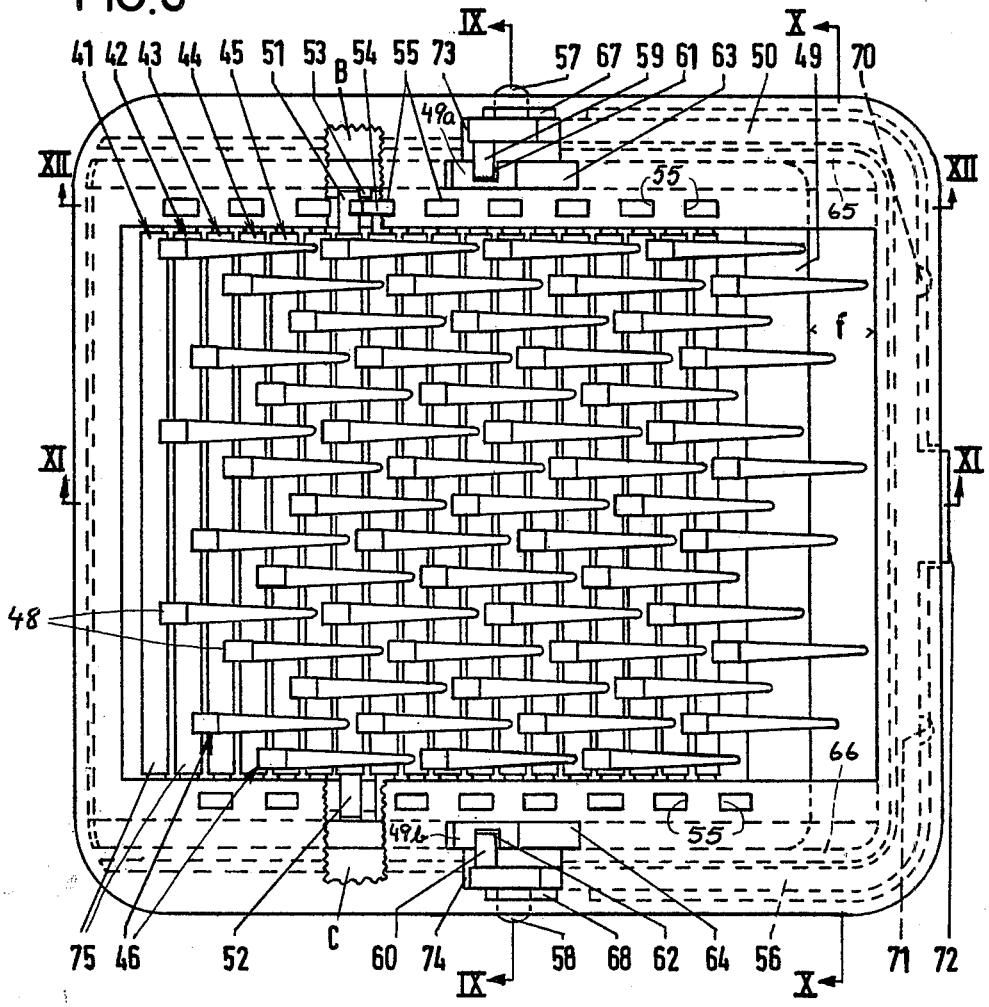
FIG. 8 is a view similar to FIG. 1, illustrating another embodiment of our invention.
Figure 9:
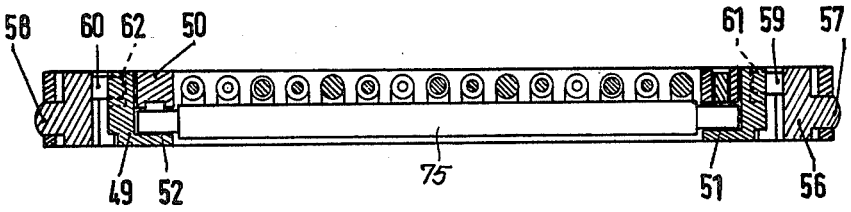
FIGS. 9, 10, 11, 12 are cross-sectional views taken on lines IX IX, X— X, XI— XI and XII XII, respectively, of FIG. 8.
Figure 10:
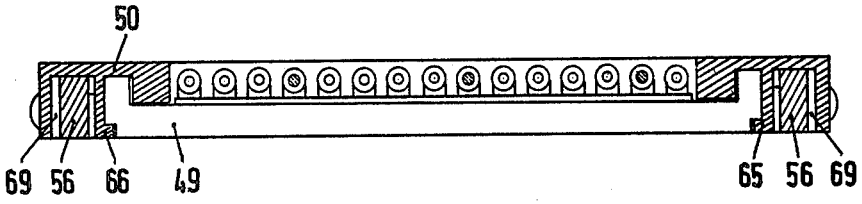
Figure 11:
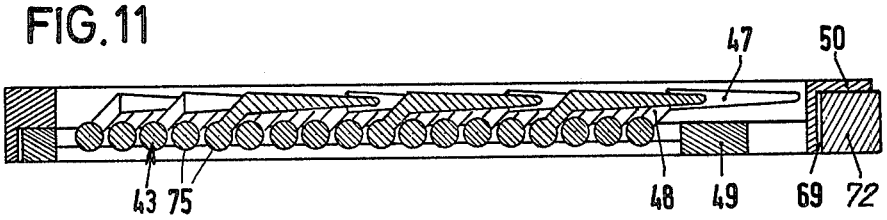
Figure 12:
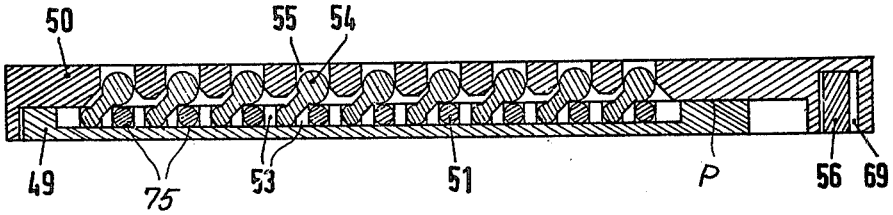
Figure 13:
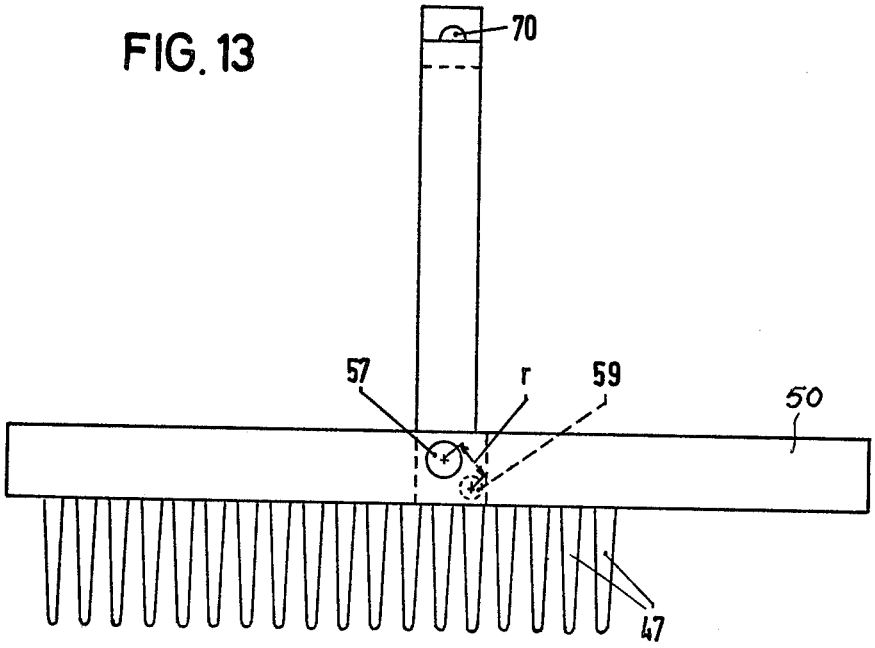
FIG. 13 is a side view of the brush of FIGS. 8– 12 in its working position.

The shafts 75 have gudgeons 51, 52 by which they are journaled in gaps between webs 53 which are integral with the frame 49 and terminate at the parting plane P. The coupling levers 54, whose shape is similar to that of levers 9 (FIG. 6), have bulges received in camming apertures 55 of frame 50. As seen in FIG. 8, these camming apertures are relatively staggered on opposite edges of frame 50 to entrain the coupling levers 54 of alternate shafts 75; note cut-away areas B and C.

A handle 56 is generally similar to handle 15 of the preceding embodiment and has a tongue 72, normally received in a cutout of frame 50, as well as detents 70, 71 releasably holding the handle in its withdrawn position. Handle 56 is pivotally linked with both relatively shiftable members 49 and 50, via pivot pins 57, 58 fulcrumed in frame 50 and via studs 59, 60 received in notches 61, 62 of frame 49; the pins and the studs are separated by a distance *r* (see FIG. 13). Notches 61, 62 are formed in lugs 49*a*, 49*b* of frame 49 which terminate flush with the working surface of frame 50 and engage in slits 63, 64 of the latter frame. The two frames have interfitted lateral profiles, frame 49 being guided in the frame 50 by relatively thin walls 65, 66 of L-shaped cross-section. These profiles are sufficiently deformable to facilitate the assembly of the parts; walls 65, 66 constitute the inner boundary of a U-shaped groove 69 accommodating the handle 56 in its inoperative position. In view of the positive linkage of the handle with both shiftable members 49 and 50, it is not necessary in this instance to insert any part of the handle into the clearance *f* inasmuch as the indexing of the handle by its detents 70, 71 prevents any untimely shifting. In the working position, the resiliently outwardly biased legs of the handle again snap into recesses 67 and 68 formed on one of the members, here the frame 50; the length of studs 59 and 60 is sufficient to hold the handle 56 engaged with the other member 49. Cutouts 73 and 74 in frame 50 facilitate the erection of the handle into the position of FIG. 13.

Figure 14:
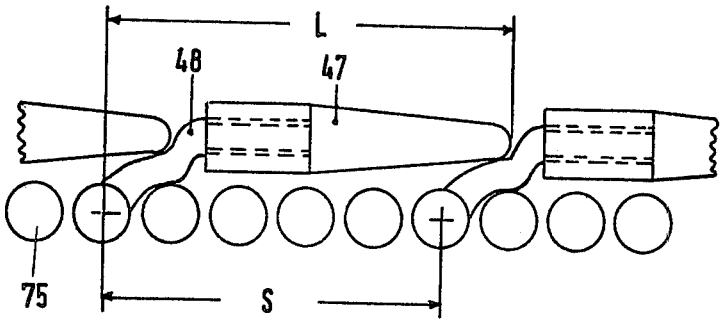
FIG. 14 is a fragmentary detail view illustrating a modification.

As illustrated in FIG. 14, the bristle units may be overlappingly disposed in rows in which each carrier 48 (except the last of a row) is overlain by the tip of an adjoining bristle 47 of that row. Thus, the effective length L of each bristle unit exceeds the spacing S of the shafts 75 of successive carriers of a given row. Such a compact arrangement is not limited to an orthogonal array as shown in FIG. 8, in which the carriers form both rows and columns, but could also be used with a layout like the one illustrated in FIG. 1 where the carriers are independently journaled. Such an overlap can also be employed where the bristles do not lie exactly parallel to the major surfaces of the brush body in their withdrawn position but include an acute angle therewith so as to be swingable through an arc of somewhat less than 90° between their collapsed and extended positions.

Figure 16:
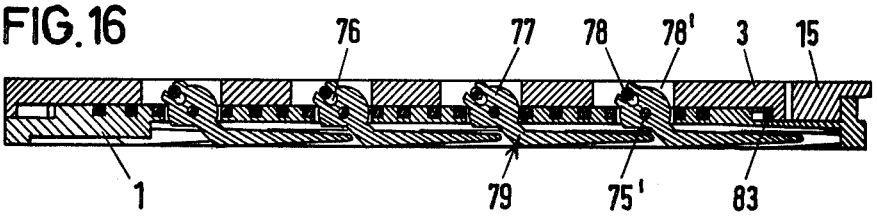
FIG. 16 is a cross-sectional view taken on the line XVI— XVI of FIG. 15.
Figure 17:
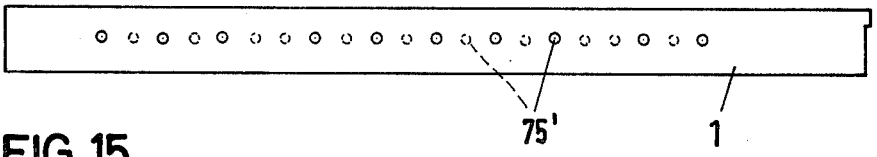
FIG. 17 is a side view of the brush shown in FIGS. 15 and 16.
Figure 15:
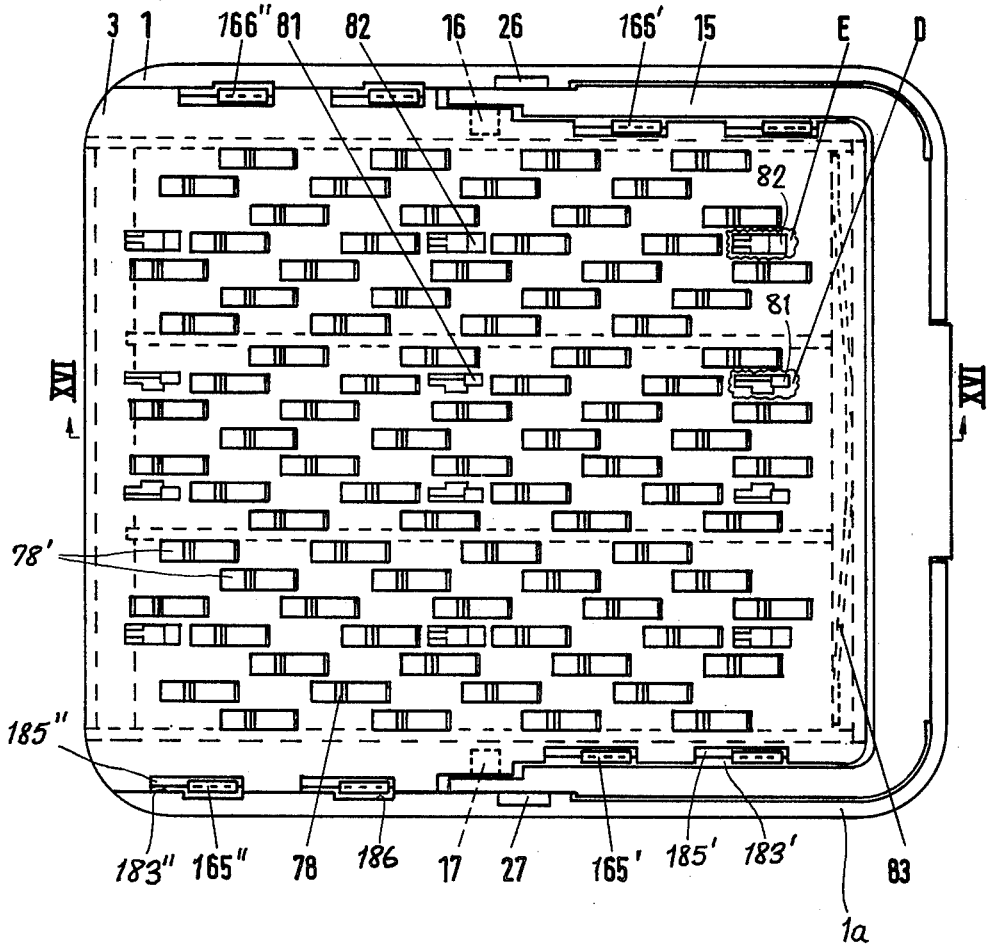
FIG. 15 is a top view of a further embodiment of our invention.
Figure 22:
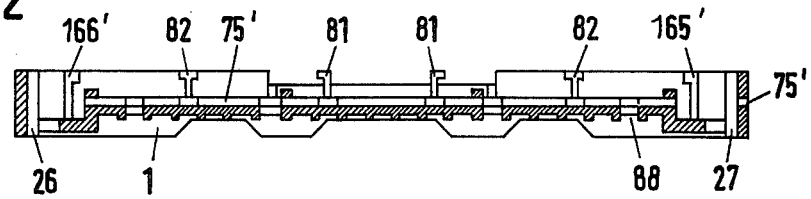
FIG. 22 is a cross-sectional view taken on line XXII— XXII of FIG. 20.
Figure 21:
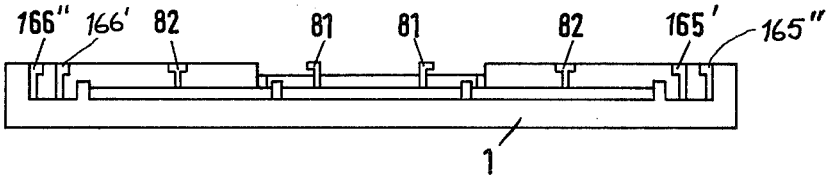
FIGS. 20 and 21 are top and end views, respectively, of a perforated bottom plate forming part of the brush of FIGS. 15– 19.
Figure 20:
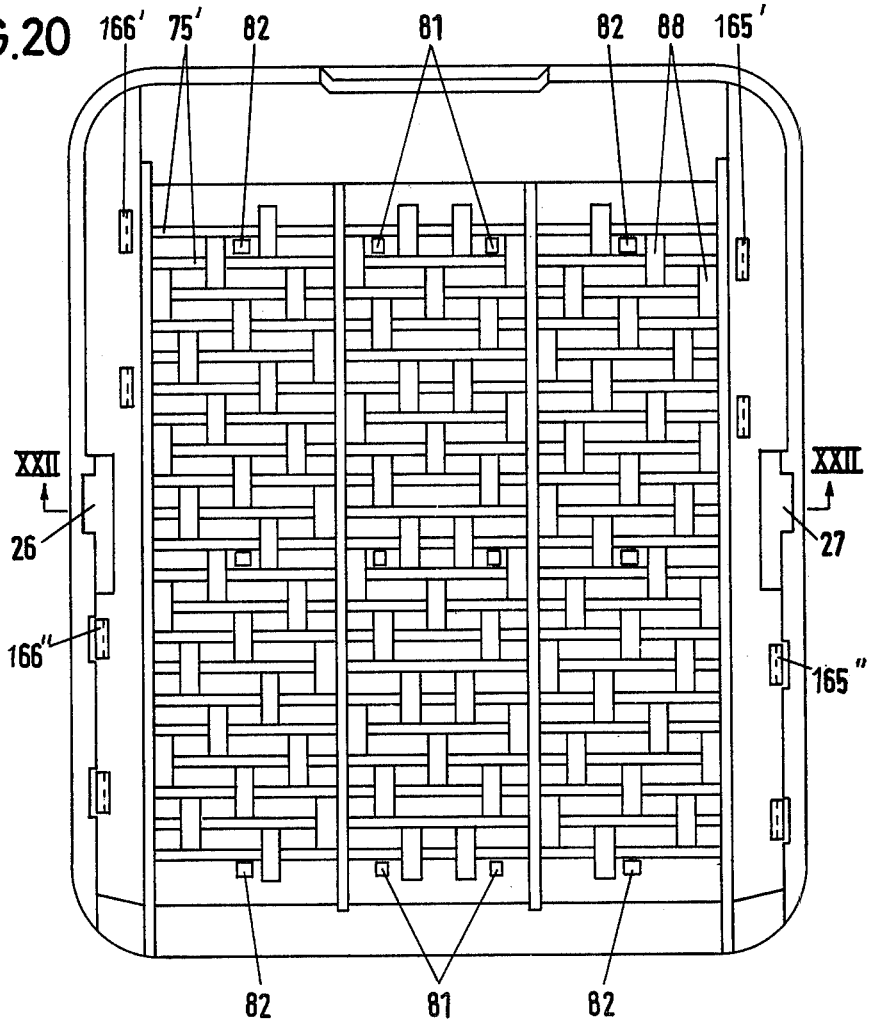

The embodiment of FIGS. 15– 28 is similar to that of FIGS. 1– 7 and the same reference numerals have been used to identify corresponding elements. Here the bristle units, designated 79, comprise carriers 77 terminating in bifurcations 76 and have center holes 80 which are traversed by rods 75' of stiff wire. The rods or bristles shafts 75' are more or less alternately mounted in opposite sides of bottom frame 1, as indicated in FIG. 17. The bifurcations 76 are received in apertures or slots 78' of top plate 3 which are traversed by pins 78 cammingly engaging the prongs of these bifurcations. Thus, a shift of plate 3 to the right from the position illustrated in FIGS. 15– 17, after an upswing of handle 15 as described above, will again rotate the bristle units about axes transverse to the shift direction into a working position perpendicular to the major surfaces of brush body 1, 3.

As illustrated in FIGS. 23A, 23B and 24A, 24B, bristle units 35 or 79 can be provided with shoulders 87 at the junctions of their bristles with the associated carriers, these shoulders coming to rest on the underside of the slotted bottom plate 1 — constituting the working surface of the brush — in the extended position shown in FIGS. 23B and 24B in order to backstop the bristles against pressure from the right and to prevent their pivotal axles (10, 11 or 75) from being forced out of their upwardly open seats.

In FIGS. 15– 28 we have further shown a releasable connection between the two plate members 1, 3 which, of course, could also be used with the bristle units of FIGS. 1– 7. Bottom plate 1 is provided with a multiplicity of upstanding lugs 81, 82 extending into rabbeted slits 83, 83' of top plate 3. Lugs 81 are of inverted-L shape and have heads 84 overlying ledges 85 within slits 83; lugs 82 are T-shaped with heads 84', 84'' overlying respective ledges 85', 85'' in slits 83'. As indicated at cut-away areas D and E in FIG. 15 (cf. FIGS. 25A– 25C and 26A– 26C) and also shown in FIG. 18, the lugs 81 are disposed in a middle zone of the brush body with their heads 84 facing its centerline whereas the lugs 82 are positioned laterally of that zone. Slits 83 have indentations 86 which enable the lugs 81 to be disengaged by being resiliently bent out of their normal upright position. Ledges 85', 85'' form confronting indentations at **86*a* to permit the extraction of heads 84', 84'' of lugs 82. Both sets of lugs register with the respective indentations in an intermediate, unstable position of handle 15 in which these lugs are centered in their slits, as seen in FIGS. 25B and 26B; no separation of the brush halves is thus possible in the retracted position FIGS. 25A, 26A) or in the working position (FIGS. 25C, 26C**).

As shown in FIGS. 15 and 20 – 22, the bottom plate 1 is further provided in this instance with hooks 165', 165'' and 166', 166'' of inverted-L shape, similar to that of lugs 81, which engage in cutouts 183', 183'' of top plate 3 having recessed ledges or rabbets 185', 185''. The hooks and cutouts 165', 166', 183' in the region of handle 15 are positioned further inwardly than their counterparts 165'', 166'', 183'' beyond that handle. Rim **1*a* of bottom plate 1 is formed in the region of cutouts 183'' with indentations 186 facilitating the disengagement of hooks 165'', 166'' from ledges 185''; hooks 165', 166' can be readily bent out of their cutouts 183'' upon a lifting of handle 15**.

The swingable and lockable handle 15 or 56 of our improved brush construction serves not only as an actuator for the erection or retraction of the bristles but also as a grip for holding the brush in use. The members of the brush body, being positively guided over their entire area in the embodiments of FIGS. 1 – 7 and 15 – 28, can be made of thin resinous sheet material and can thus be manufactured very economically. The frame-type brush body of FIGS. 8 – 13 has the advantage of very light weight.

It will be evident that features illustrated in different embodiments may be combined or substituted for one another within the limits of compatibility. Thus, for example, couplings of the type shown either in FIGS. 23A, 23B or in FIGS. 24A, 24B may be interchangeably utilized in any of the overall structures described.

We claim:

1. A collapsible brush comprising:

a generally flat body with a first member defining a first major surface or said body and a second member defining a second major surface of said body, said second member being superposed on said first member with limited relative slidability in a predetermined direction along a parting plane generally parallel to said major surfaces between a first and a second stop position;

a set of bristle carriers journaled in one of said members and provided with coupling formations extending across said parting plane into engagement with coacting camming formations within the other of said members for swinging said carriers and their bristles about pivotal axes transverse to said predetermined direction upon a relative shift of said members between said stop positions, said bristles being retracted into said first member in said first stop position and projecting perpendicularly from said first major surface in said second stop position; and connecting elements on one of said members passing through slits on the other of said members and terminating in heads holding said members together.

2. A brush as defined in claim 1 wherein said heads lie below said second surface.

3. A brush as defined in claim 1 wherein said slits have indentations enabling separation of said members from each other in an intermediate relative position between said first and second stop positions.

4. A brush as defined in claim 1 wherein said second member is provided with apertures which open onto said second surface and receive said coupling formations.

5. A brush as defined in claim 4 wherein said coupling formations are rounded bulges and said camming formations are pairs of opposite edges of said apertures bracketing said bulges.

6. A brush as defined in claim 4 wherein said coupling formations are bifurcations and said camming formations are pins within said apertures straddled by said bifurcations.

7. A collapsible brush comprising:

a generally flat body with a first member defining a first major surface of said body and a second member defining a second major surface of said body, said second member being superposed on said first member with limited relative slidability in a predetermined direction along a parting plane generally parallel to said major surfaces between a first and a second stop position;

a set of bristle carriers journaled in one of said members and provided with coupling formations extending across said parting plane into engagement with coacting camming formations within the other of said members for swinging said carriers and their bristles about pivotal axes transverse to said predetermined direction upon a relative shift of said members between said stop positions, said bristles being retracted into said first member in said first stop position and projecting perpendicularly from said first major surface in said second stop position; and a handle fulcrumed on one of said members for rotation about a swing axis parallel to said pivotal axes between an inoperative position within said body and an operative position rising from said second major surface, said handle engaging the other of said members at least in said inoperative position for preventing a relative shift of said members from said first stop position to said second stop position.

8. A brush as defined in claim 7 wherein said carriers are arrayed in parallel rows with common swing planes, all carriers except the last one in each row being overlain by tips of adjoining bristles in a retracted position thereof.

9. A brush as defined in claim 7 wherein said carriers are arrayed in columns transverse to said swing planes, the carriers of each column being provided with a common shaft, said coupling formations being secured to extremities of the shafts of said columns.

10. A brush as defined in claim 7 wherein said handle is yoke-shaped with resilient legs positioned to snap into recesses on the other of said members in said operative position to hold said members in said second stop position.

11. A brush as defined in claim 10 wherein said handle has a bight portion received in a clearance between a transverse edge of said second member and an abutment on said first member in said inoperative position thereof.

12. A brush as defined in claim 10 wherein said bight portion is provided with detent means for yieldably holding said handle in said inoperative position thereof.

13. A brush as defined in claim 10 wherein said legs are pivotally linked with both said members for positively shifting same upon movement of said handle between said inoperative and operative positions thereof.

14. A brush as defined in claim 10 wherein said members are provided with spring means for shifting same into said second stop position upon movement of said handle from said inoperative position into said operative position thereof.

15. A brush as defined in claim 7 wherein one of said members is provided with connecting elements passing through slits in the other of said members and terminating in heads holding said members together.

16. A collapsible brush comprising:

a generally flat body with a first member defining a first major surface of said body and a second member defining a second major surface of said body, said second member being superposed on said first member with limited relative slidability in a predetermined direction along a parting plane generally parallel to said major surfaces between a first and a second stop position;

a set of bristle carriers journaled in one of said members and provided with coupling formations extending across said parting plane into respective apertures of the other of said members for swinging said carriers and their bristles about pivotal axes transverse to said predetermined direction upon a relative shift of said members between said stop positions, said coupling formations terminating in rounded bulges bracketed by pairs of opposite edges of said respective apertures, said bristles being retracted into said first member in said first stop position and projecting perpendicularly from said first major surface in said second stop position; and operating means on said body for relatively shifting said members.

17. A brush as defined in claim 16 wherein said coupling formations are lever arms oriented generally radially to said pivotal axes and including an obtuse angle with said bristles.

18. A brush as defined in claim 17 wherein said lever arms include an angle of substantially 45° with said parting plane in each of said stop positions.

19. A brush as defined in claim 18 wherein said lever arm lie in the swing planes of said bristles.

20. A brush as defined in claim 16 wherein said carriers are provided with shoulders coming to rest against said first major surface in said second stop position.

* * * * *